US005975917A

United States Patent [19]

Wang et al.

[11] Patent Number: 5,975,917

[45] Date of Patent: Nov. 2, 1999

[54] METHOD FOR MANUFACTURING AN ELECTRICAL CONNECTOR AND ELECTRICAL CONNECTOR MANUFACTURED BY THE SAME

[75] Inventors: Kuo-Cheng Wang, Tu-Cheng, Taiwan; Wayne Huang, Alhambra, Calif.

[73] Assignee: Hon Hai Precision Ind. Co., Ltd., Taipei Hsien, Taiwan

[21] Appl. No.: 09/053,421

[22] Filed: Apr. 1, 1998

[51] Int. Cl.[6] ..... H01R 9/09

[52] U.S. Cl. ..... 439/79; 29/884; 439/701

[58] Field of Search ..... 439/79, 701, 590, 439/937, 682; 29/879, 876, 883, 884

[56] References Cited

U.S. PATENT DOCUMENTS 5,098,311 3/1992 Roath et al. ..... 439/683
5,133,679 7/1992 Fusselman et al. ..... 439/79
5,558,542 9/1996 O'Sullivan ..... 439/682
5,643,008 7/1997 Tan et al. ..... 439/701
5,651,685 7/1997 Brinkman et al. ..... 439/79

*Primary Examiner*—Neil Abrams
*Assistant Examiner*—J. F. Duverne

[57] ABSTRACT

A method for manufacturing an electrical connector (20) comprises the steps of forming an insulative housing (24) defining a mating opening (33) in a front face thereof for mating with a second electrical connector and a central cavity (38) defined in a rear face of the housing (24), forming a contact module (26) including at least one row of conductive contacts (27) received therein, the contacts (27) each defining a contact section (52) for mating with a second contact of the second connector and a tail section (56) for engaging with a printed circuit board, and inserting the contact module (26) into the central cavity (38). An electrical connector (20) formed by such a method and the contact module (26) used with such an electrical connector (20) are also disclosed.

11 Claims, 10 Drawing Sheets

METHOD FOR MANUFACTURING AN ELECTRICAL CONNECTOR AND ELECTRICAL CONNECTOR MANUFACTURED BY THE SAME

BACKGROUND OF THE INVENTION

1. Field of The Invention

The present invention relates to a method for manufacturing for an electrical connector and an electrical connector resulting from such method.

2. The Prior Art

In a conventional electrical connector, such as the connector 10 shown in FIG. 1, a conductive contact 12 is inserted into a passageway 16 defined in an insulative housing 14 thereof. To minimize the size of an electrical connector to meet the requirements of portable computers having reduced size, the distance between two contacts 12 becomes so small that it is difficult to insert them into the passageways.

Hence, it is requisite to provide an improved manufacturing technique to improve this situation.

SUMMARY OF THE INVENTION

Accordingly, one object of the present invention is to provide an improved electrical connector manufacturing method which achieves high contact density.

Another object of the present invention is to provide a contact module that can be easily inserted into an insulative housing of an electrical connector.

A further object of the present invention is to provide an improved electrical connector manufactured by such a method.

To fulfill the above mentioned objects, according to one embodiment of the present invention, a method for manufacturing an electrical connector comprises the steps of: forming an insulative housing defining a mating opening in a front face thereof for mating with a second electrical connector and a central cavity defined in a rear face of the housing, forming a contact module including at least one row of conductive contacts received therein, the contacts each defining a contact section for mating with a second contact of the second connector and a tail section for engaging with a printed circuit board, and inserting the contact module into the central cavity.

In another aspect, a contact module for use in an electrical connector comprises a pair of contact sets jointed together, each including at least one molded plate and one row of conductive contacts molded in the at least one molded plate, each contact defining a contact section for mating with a second contact and a tail section for engaging with a printed circuit board.

In still another aspect, an electrical connector comprises an insulative housing defining a mating opening in a front face thereof for mating with a second electrical connector and a central cavity defined in a rear face of the housing, and a contact module received in the central cavity including at least one row of conductive contacts received therein, the contacts each defining a contact section for mating with a second contact of the second connector and a tail section for engaging with a printed circuit board.

These and additional objects, features, and advantages of the present invention will become apparent after reading the following detailed description of the embodiments of the invention taken in conjunction with the appended drawing figures.

DETAILED DESCRIPTION OF THE PREFERRED EMBODIMENTS

Detailed reference will now be made to the preferred embodiments of the present invention.

Figure 1:
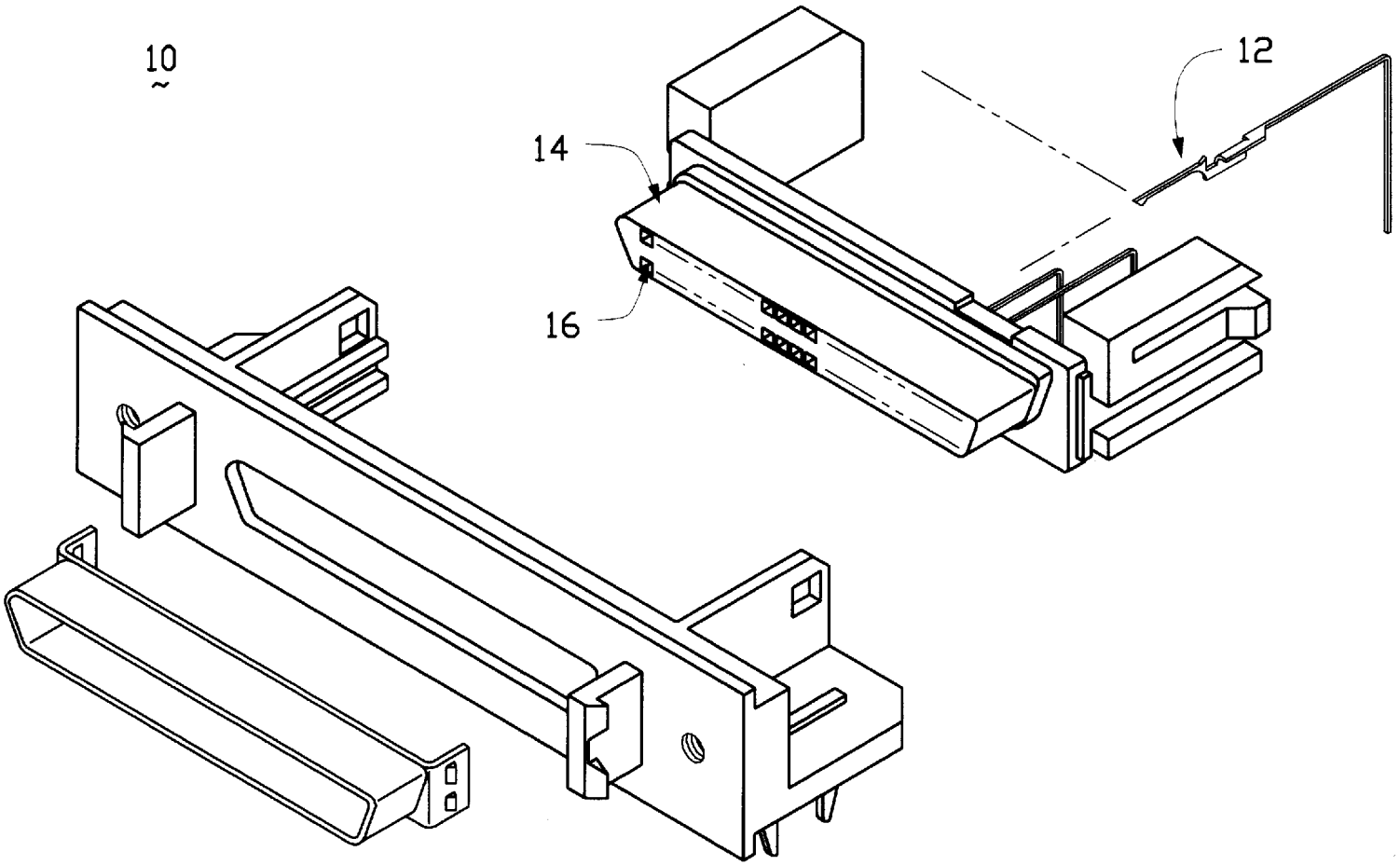
FIG.1 (PRIOR ART)
FIG. 1 is an exploded perspective view of a conventional electrical connector.
Figure 2:
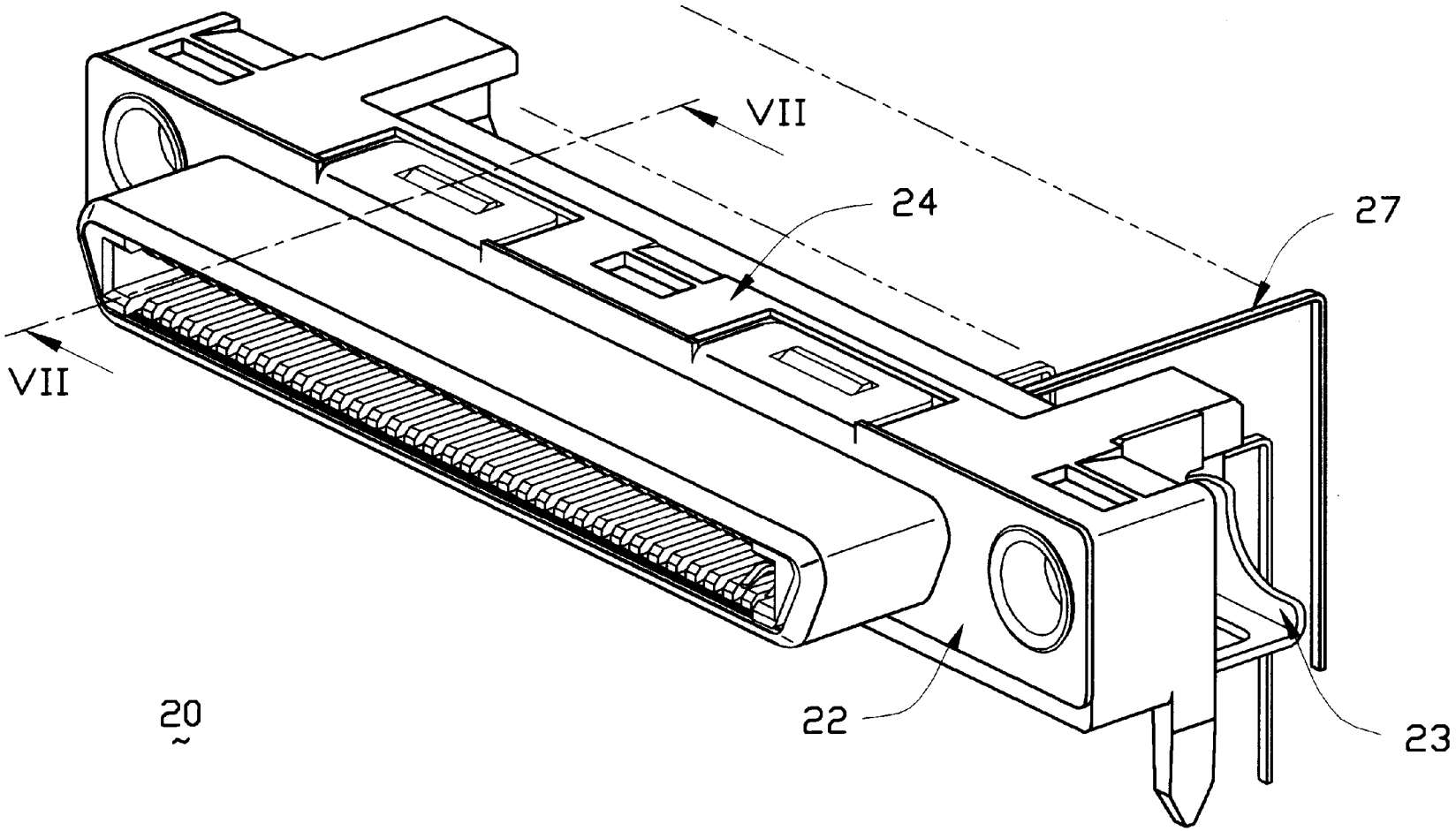
FIG. 2 is a perspective view of an electrical connector according to a preferred embodiment of the present invention.
Figure 3:
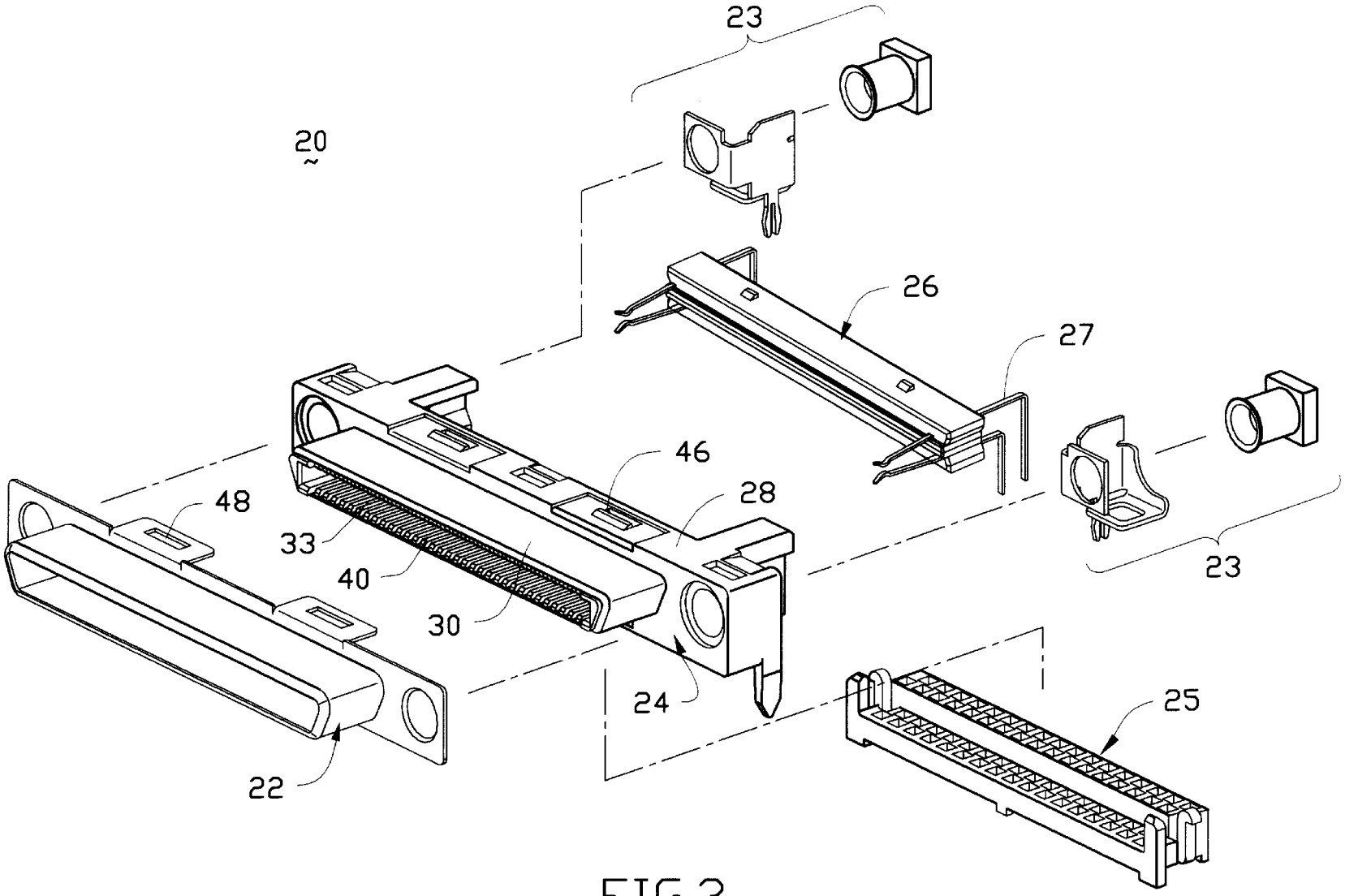
FIG. 3 is an exploded perspective view of the electrical connector shown in FIG. 2.

Referring first to FIGS. 2 and 3, an electrical connector in accordance with the present invention, generally designated by reference numeral 20, mainly comprises a metal shield 22, a pair of interlocking devices 23, an insulative housing 24, a contact module 26 including a plurality of conductive contacts 27, and a spacer 25 for alignment of tail sections 56 of the contacts 27.

Figure 4:
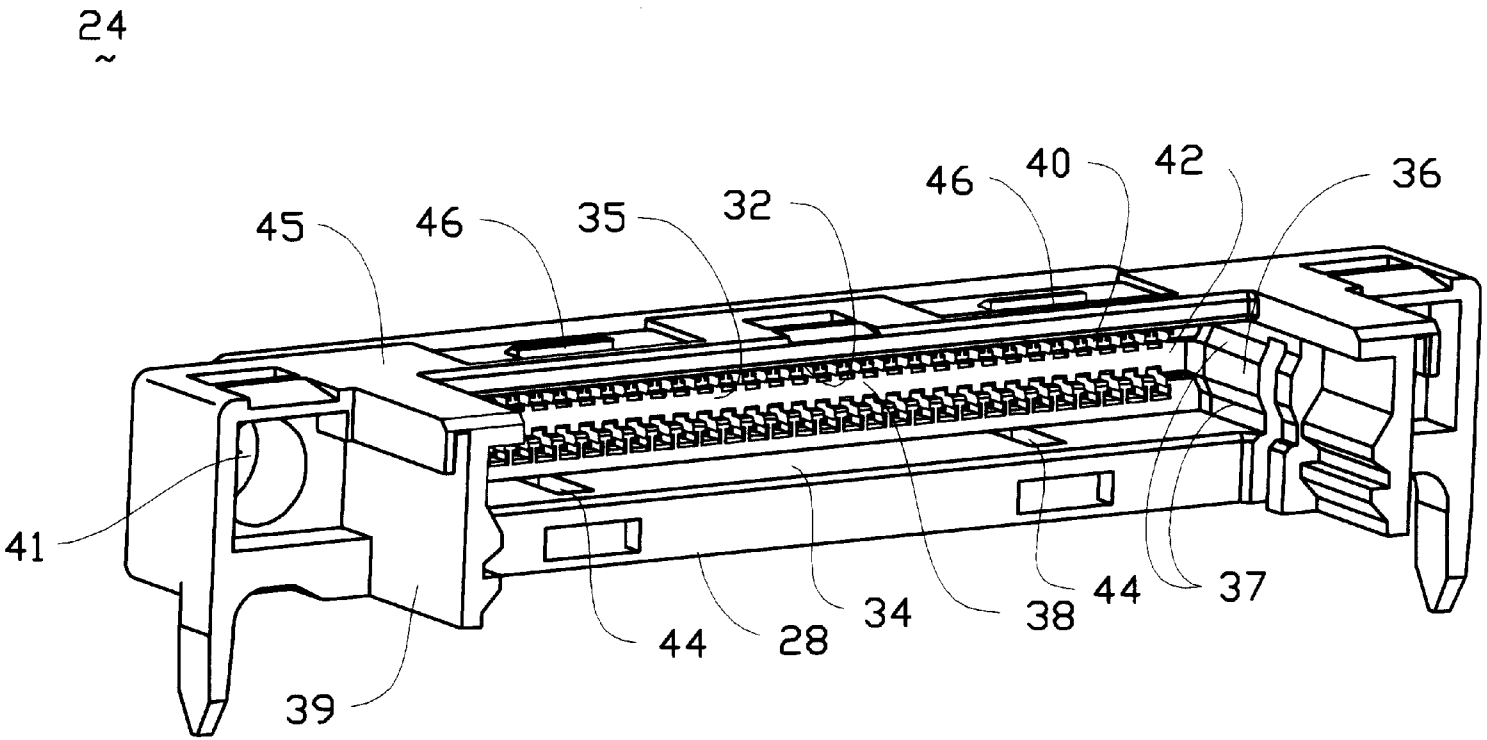
FIG. 4 is a rear perspective view of an insulative housing according to the present invention.

Also referring to FIG. 4, the housing 24 includes a main body 28, a mating protrusion 30 projecting forward from the main body 28 defining a mating opening 33 for mating with a mating connector (not shown), a pair of walls 39 extending rearward from the main body 22 for attachment of the spacer 25, a central cavity 38 defined in the rear face of the main body 28 between the walls 39 for receiving the contact module 26, and a pair of through holes 41 defined near both lateral ends of the main body 22 for securing the interlocking devices 23.

The central cavity 38 includes an upper surface 32, a lower surface 34, an innermost surface 35, a pair of opposite lateral surface 36, a transverse recess 42 defined in the innermost surface 35 for receiving a transverse protrusion 82 of the contact module 26, a pair of grooves 37 defined in each of the lateral surface 36 for receiving lateral flanges 80 of the contact module 26, and a plurality of detents 44 defined in the upper and lower surfaces 32, 34 for retention of ribs 66 formed on outer surfaces of the contact module 26.

The housing 28 further includes two rows of passageways 40 defined in the mating opening 33 and through the innermost surface 35 of the central cavity 38 for receiving front contact sections 52 of the contacts 27 and a plurality of ribs 46 defined in a top portion 45 and a bottom portion (not shown) thereof for retention in retaining slots 48 of the metal shield 22.

Figure 5:
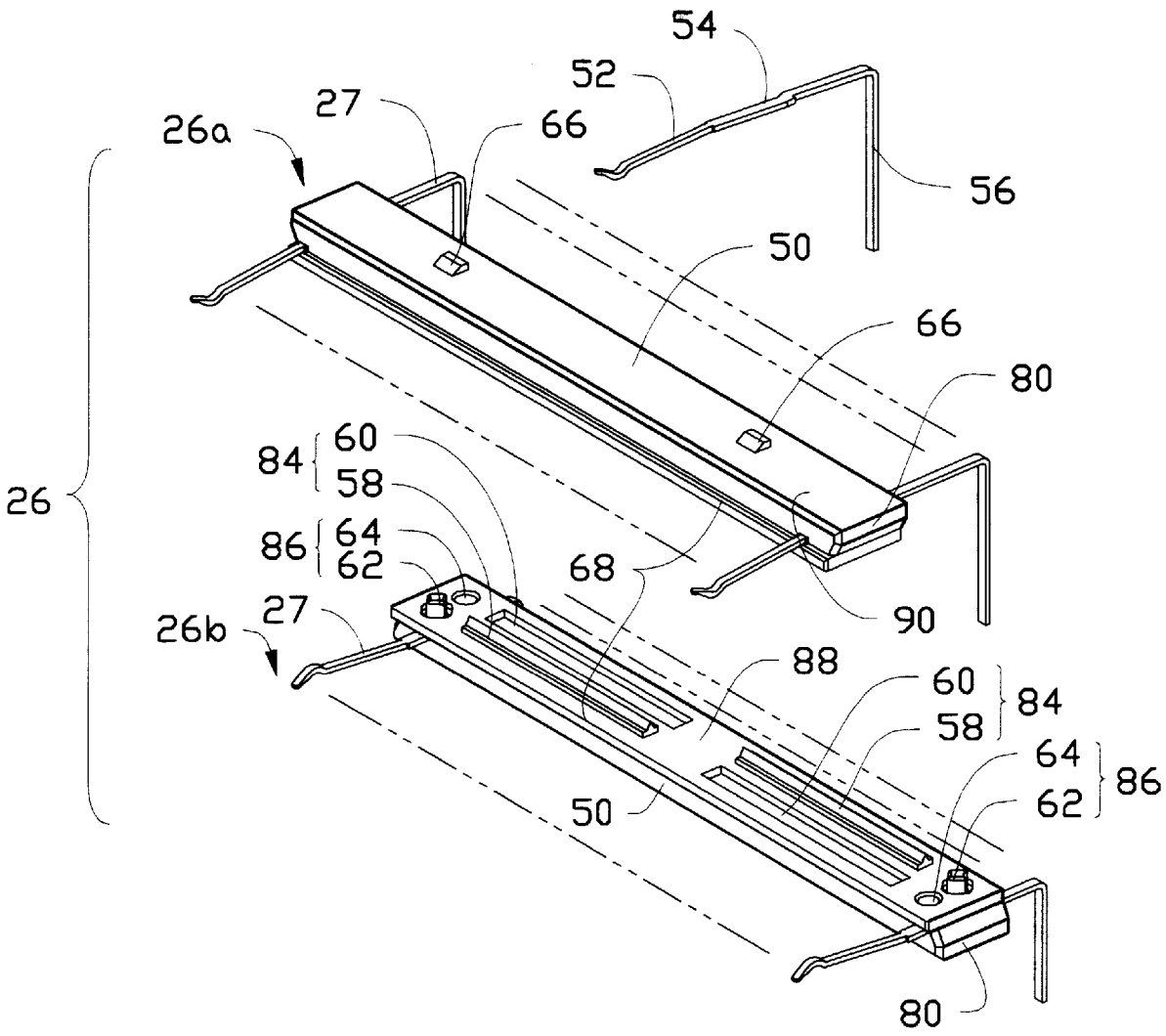
FIG. 5 is an exploded perspective view of a contact module according to the present invention.

Referring to FIG. 5, the contact module 26 comprises an upper contact set 26*a* and a lower contact set 26*b*, each including a plate 50 and a row of the contacts 27 transversely and horizontally aligned and molded therein. The upper and lower contact sets 26*a*, 26*b* are basically the same except that the tail sections 56 of the respective contact sets 26*a*, 26*b* are bent at different locations and in opposite directions (also see FIG. 7). Each plate 50 comprises two sets of joint means 86 on a first jointing surface 88 near each lateral end thereof, two sets of bonding means 84 between the joint means 86, a lateral flange 80 formed on each lateral edge of a second opposing surface 90 of the plate 50, a front flange 68 formed on a front edge of the jointing surface 88 of the plate 50, and a pair of ribs 66 formed on the opposing surface 90 of the plate 50. Each set of joint means 86 includes a square post 62 and a circular hole 64, and each set of bonding means 84 includes an elongate shallow 60 and a strip 58, wherein the posts 62 and holes 64 in the two sets of joint means 86 are located in reversed positions, as are the shallows 60 and strips 58 of the bonding means 84.

Each contact 27 includes a fixing section 54, the contact section 52 extending forward from the fixing section 54, and the tail section 56 extending rearward and downward from the fixing section 54. Since the tail sections 56 of the contacts 27 of each contact set 26*a*, 26*b* are alternately bent at one of two different locations and the two different locations are not the same for the upper contact set 26*a* and the lower contact set 26*b*, there are four rows of tail sections 56 in the contact module 26 when the upper and lower contact sets 26*a* and 26*b* are jointed by their respective jointing faces 88.

Figure 6:
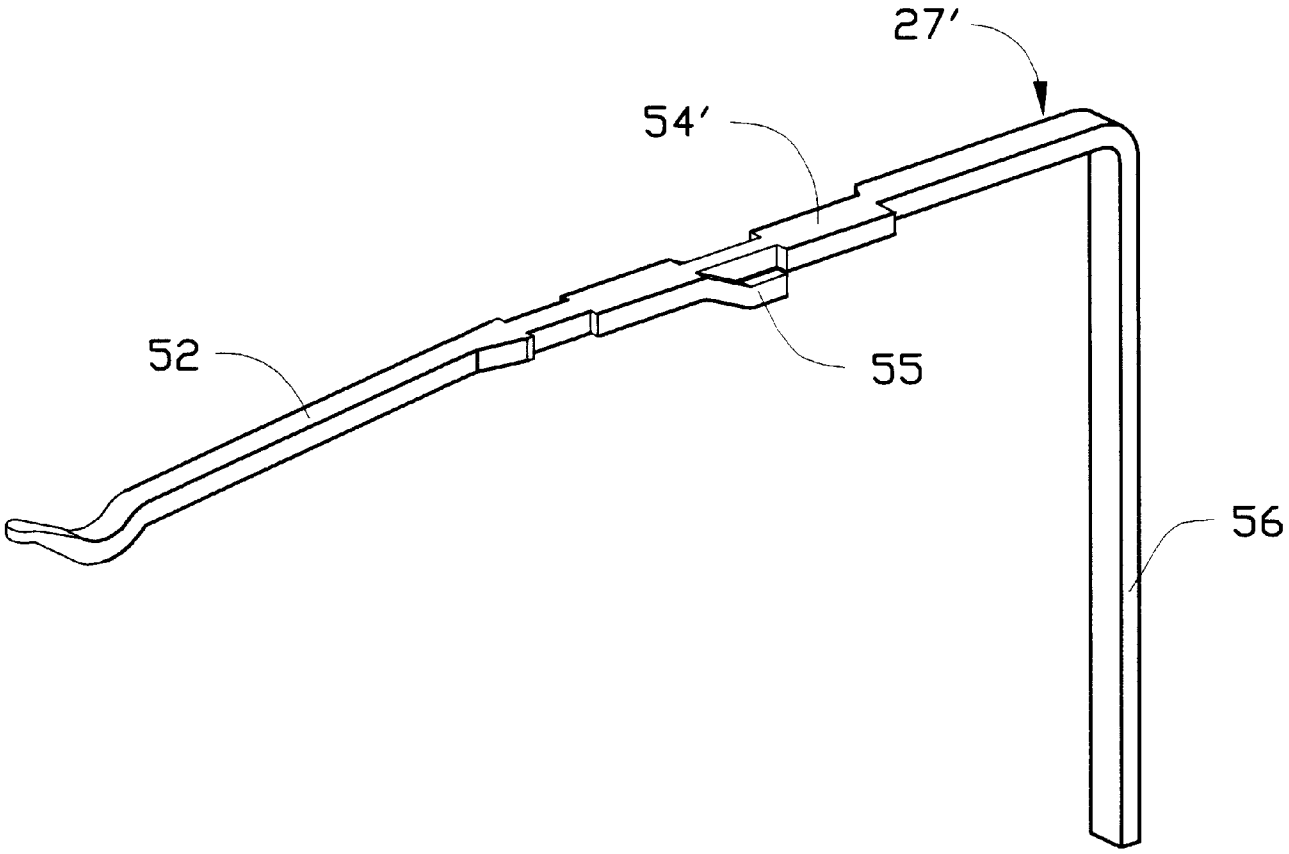
FIG. 6 shows a second embodiment of a conductive contact according to the present invention.

Referring to FIG. 6, another embodiment of the contact, designated by reference numeral 27', comprises the front contact section 52, the tail section 56, and a fixing section 54' including a pair of tangs 55 stamped from a plane defined by the fixing section 54' for increasing the fixing strength with the plate 50.

Referring to FIGS. 8A–8I, the process for manufacturing the present electrical connector mainly comprises the steps of:

(A) cutting a length of carrier 70 containing a specific number of stamped contacts 27 attached thereto;

(B) forming the plate 50 by an insert molding process whereby a portion of the fixing sections 54 of the contacts 27 are embedded in the plate 50;

(C) cutting off the redundant portion 72 of the carrier 70 to form a contact set 26';

(D) forming the upper contact set 26*a* by bending the tail portions 56 of one contact set 26' to form two rows;

(E) forming the lower contact set 26*b* by bending the tail portions 56 of another contact set 26' to form two rows;

(F) jointing the upper and lower contact sets 26*a* and 26*b* by the jointing means 86;

(G) bonding the upper and lower contact sets 26*a* and 26*b* by an ultrasonic welding procedure;

(H) providing the insulative housing 24 and inserting the contact module 26 into the central cavity 38 thereof; and (I) providing the metal shield 22, the interlocking device 23, and the spacer 25.

In step (F) of jointing the upper and lower plates 26*a*, 26*b* together, the two sets of joint means 86 of the upper plate 68 interferentially engage with the corresponding two sets of joint means 86 of the lower plate 26*b*. The posts 62 of the upper plate 26*a* fit into the holes 64 of the lower plate 26*b*, the elongate shallows 60 and strips 58 of the upper plate 26*a* engage with the strips 58 and shallows 60 of the lower plate 26*b*, respectively, and the two front flanges 68 overlap and form the transverse protrusion 82 (see FIG. 7) of the contact module 26.

In step (G) of bonding the upper and lower contact sets 26*a* and 26*b* by an ultrasonic welding procedure, the strips 58 melt when subject to ultrasonic waves and then bond into the shallows 60 upon solidification. Thus, a unitary contact module 26 including two rows of contacts 27 integrally formed therein is complete.

Figure 7:
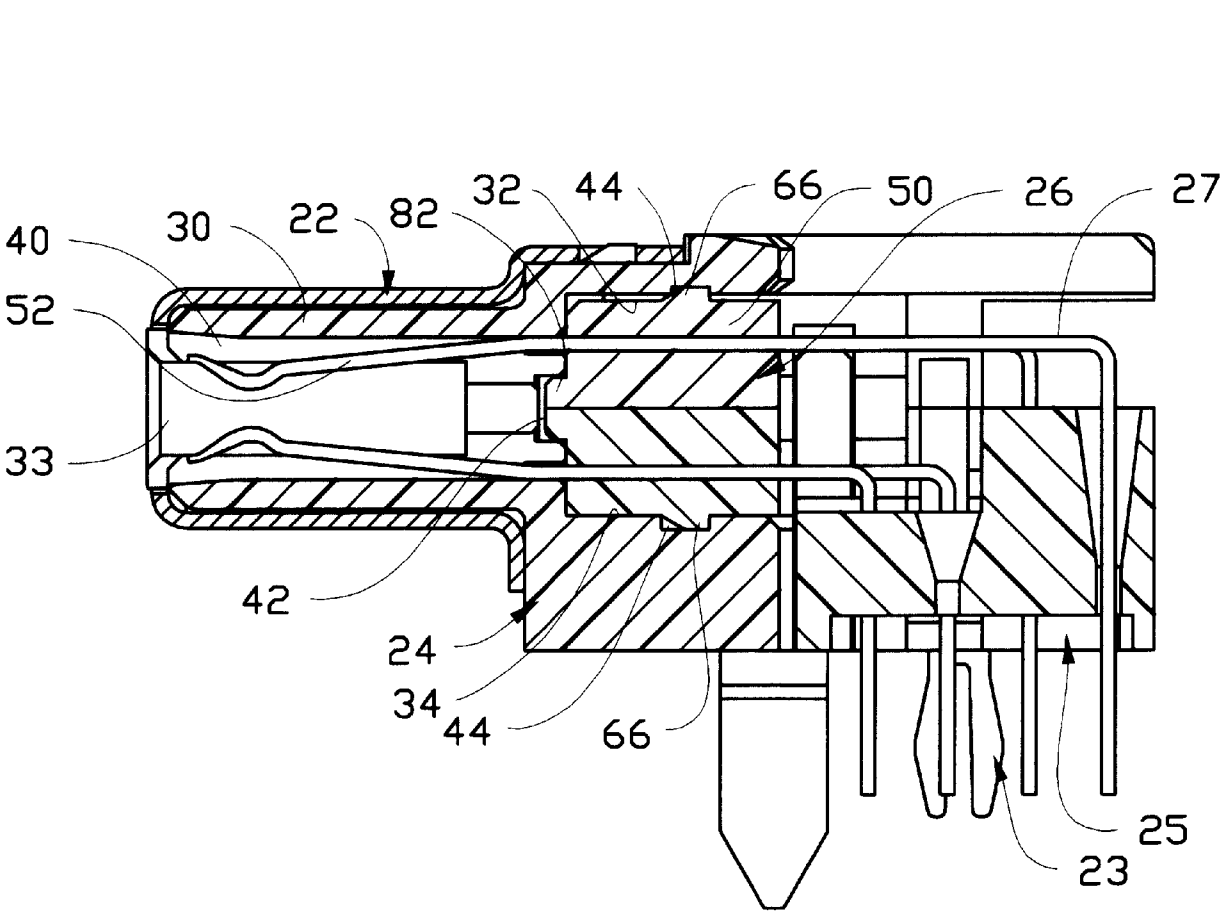
FIG. 7 is a cross-sectional view of the electrical connector taken along line VII—VII of FIG. 2.
Figure 8A:
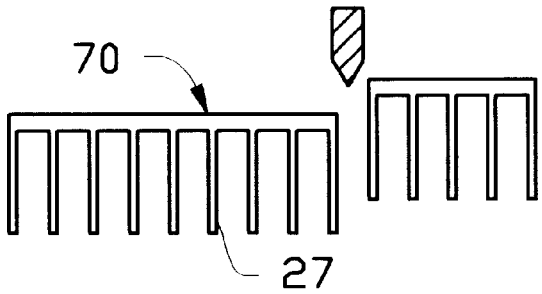
FIGS. 8A–8I show a process for manufacturing the electrical connector shown in FIG. 2.
Figure 8B:
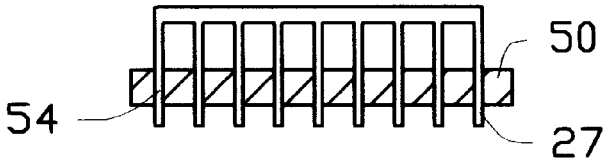
Figure 8C:
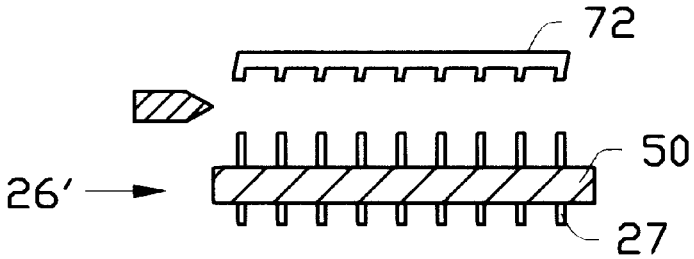
Figure 8D:
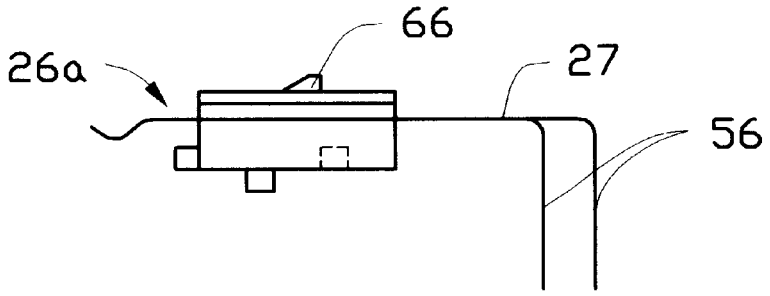
Figure 8E:
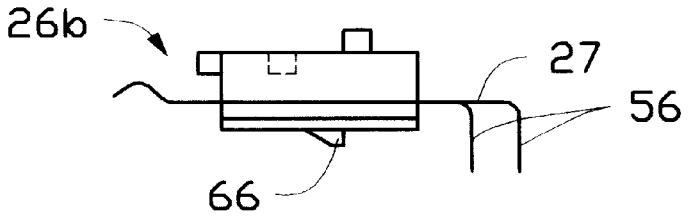
Figure 8F:
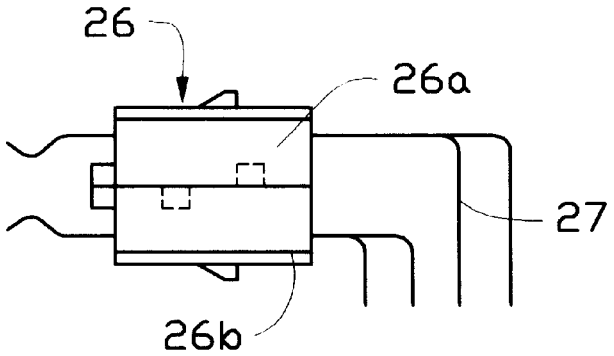
Figure 8G:
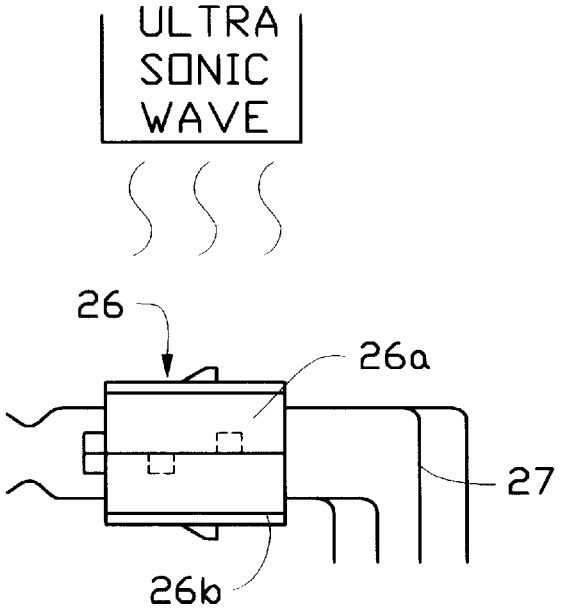
Figure 8H:
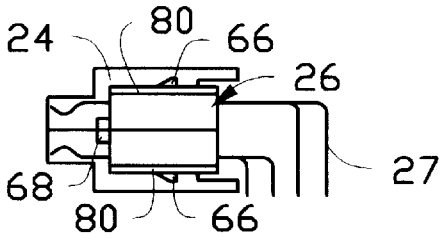
Figure 8I:
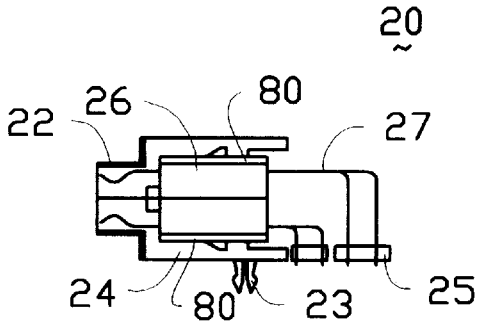

In step (H), when the contact module 26 is inserted into the central cavity 38, the lateral flanges 80 are guided by and slide along the lateral grooves 37 of the central cavity 38. When the contact module 26 is completely inserted into the central cavity 38, the transverse protrusion 82 fits into the transverse recess 58 in the innermost surface 35 and the ribs 66 of the contact module 26 are retained in the corresponding detents 44, as shown in FIG. 7.

In step (I), the metal shield 22 is provided over the mating protrusion 30, the slots 48 of the metal shield 22 are retained by the ribs 46 of the housing 24 and the interlocking devices 23 are provided on both lateral ends of the housing 24 to fasten both itself and the metal shield 22 to the housing 24. The spacer 25 is provided between the walls 39 for alignment of the tail sections 56 of the contacts 27 to facilitate insertion of the tail sections 56 into contact holes (not shown) defined in a printed circuit board upon which the connector 20 is to be mounted. As such, the manufacturing process of an electrical connector including a contact module 26 in accordance with the present invention is completed.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A method for manufacturing an electrical connector, comprising the steps of:

forming an insulative housing defining a mating opening in a front face thereof for mating with a second electrical connector and a central cavity defined in a rear face of the housing;

forming two contact sets, each including an molded plate with a jointing surface, and at least one row of conductive contacts molded therein each defining a contact section for mating with a second contact of said second connector and a tail section for engaging with a printed circuit board;

securely jointing said contact sets together by an interfering fit between two reverse joint means respectively formed on the jointing surfaces of the molded plates thereof;

bonding said contact sets into an integral unitary contact module by means of ultrasonic welding between two reverse bonding means respectively formed on the jointing surfaces of the molded plates for enhancement of the retention therebetween;

inserting said contact module into said central cavity; and accurately retaining said contact module within said cavity by means of a retention means formed between the central cavity and the contact module.

2. The method as defined in claim 1, wherein said step of inserting said contact module into said central cavity comprises the step of guiding the entrance of the contact module by guiding means provided between lateral edges of the contact module and lateral surfaces of the central cavity.

3. The method as defined in claim 1, wherein said step of forming the contact sets of the contact module further comprises the steps of:

cutting a length of carrier containing a plurality of stamped contacts attached thereto;

forming the molded plate including the contacts of said carrier molded therein; and cutting off the redundant portion of the carrier.

4. The method as defined in claim 1, wherein each said conductive contact comprises a fixing section embedded in said molded plate.

5. The method as defined in claim 1, wherein each of the molded plates of the two contact sets are identical and jointed together in the respective jointing surfaces thereof.

6. The method as defined in claim 1, wherein the bonding means of each molded plate includes two pairs of elongate shallows and strips arranged in reversed positions so that when the jointing surfaces of the two molded plates are jointed by the joint means the strips of one molded plate are received in the shallows of the other molded plate.

7. An electrical connector, comprising:

an insulative housing defining a mating opening in a front face thereof for mating with a second electrical connector and a central cavity defined in a rear face of the housing; and a contact module including at least two contact sets each including an identical molded plate with a jointing surface, and a plurality of conductive contacts molded therein each defining a contact section for mating with a second contact of said second connector and a tail section for engaging with a printed circuit board wherein the identical molded plates of the contact sets are jointed together in the respective jointing faces thereof by an interfering fit between two reverse joint means respectively formed on the jointing surfaces of the plates thereof, and integrated by means of ultrasonic welding between two reverse bonding means respectively formed on the jointing surfaces of the molded plates for enhancement of the retention therebetween before being retentively received into said central cavity.

8. The electrical connector as defined in claim 7, wherein said contact module comprises a transverse protrusion at a front edge thereof fitting into a transverse recess defined in an innermost surface of the central cavity.

9. The electrical connector as defined in claim 7, wherein at least one retention means is provided between one of the outer surfaces of said contact module and one of the inner surfaces of said central cavity for retaining said contact module in said central cavity.

10. The electrical connector as defined in claim 7, wherein at least one guiding means is provided between one of the outer surfaces of said contact module and one of the inner surfaces of said central cavity for guiding the entrance of said contact module into said central cavity.

11. The electrical connector as defined in claim 7, wherein said contacts each define a fixing section having a tang stamped from a plane defined by the fixing section and said fixing section is molded in the contact module.

* * * * *